US006050056A

United States Patent [19]

Weisser et al.

[11] Patent Number: 6,050,056

[45] **Date of Patent: *Apr. 18, 2000**

[54] PACKAGING BAGS AND APPARATUS

[75] Inventors: Karlheinz Weisser, Schifferstadt; Ulrich Wald, Speyer, both of Germany

[73] Assignee: Paper Converting Machine Company, Green Bay, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 08/757,200

[22] Filed: Nov. 27, 1996

[30] Foreign Application Priority Data

Nov. 27, 1995 [DE] Germany ..... 195 44 013

[51] Int. Cl.[7] ..... B65B 7/04; B65B 51/10

[52] U.S. Cl. ..... 53/370.6; 53/371.9; 53/372.6; 493/183; 493/308

[58] Field of Search ..... 53/370.6, 371.9, 53/372.2, 372.6, 372.7; 493/183, 184, 308, 452, 453

[56] References Cited

U.S. PATENT DOCUMENTS

| | | | |
|---|---|---|---|
| 1,933,180 | 10/1933 | Meyer-Jagenberg | 493/184 |
| 2,179,685 | 11/1939 | Chalmers | 53/370.6 X |
| 2,925,699 | 2/1960 | Ozor | 53/372.6 |
| 3,078,633 | 2/1963 | Stromberg et al. | 53/370.6 |
| 4,872,303 | 10/1989 | Johnson | 53/372.6 X |

FOREIGN PATENT DOCUMENTS

| | | |
|---|---|---|
| 625617 | 12/1962 | Belgium . |
| 0 649 734 A3 | 2/1996 | European Pat. Off. . |
| 23 52 718 A1 | 4/1975 | Germany . |
| 41 34 150 A1 | 4/1993 | Germany . |

*Primary Examiner*—Linda Johnson
*Attorney, Agent, or Firm*—Akin, Gump, Strauss, Hauer & Feld, L.L.P.

[57] ABSTRACT

A packaging bag for containing a product is provided. The bag includes an end with four bag projections that are to be folded over the product. A first pair of opposing bag projections are folded down to form generally triangular portions, and the other pair of opposing bag projections are folded onto the triangular portions and connected together in the overlap area while basically maintaining their rectangular shape and catching the corners of the first pair of bag projections. In order for the first pair of bag projections to be formed along the long side of the bag, the fold edges between adjacent bag projections run at least partially outside of the contour of the bags when folded and the angle formed between the side and base of the triangular portion when folded in is less than 45°.

8 Claims, 2 Drawing Sheets

PACKAGING BAGS AND APPARATUS

BACKGROUND OF THE INVENTION

This invention relates to packaging, and more particularly to packaging bags, especially for paper hygiene products, where on one end of the bag, the four sides of the bag project outwards, such projections being folded over the product.

In the known packaging bags, a first pair of oppositely located projections are each folded over the free side of the product, each forming an approximately equilateral triangle, the base of which runs longitudinally along one edge of the product and the sides of which run diagonally from outside to inside across the end surface of the product. The remaining pair of opposite bag projections are folded onto the triangles mentioned above, approximately retaining their rectangular shape, and are connected together in the folded down position in the area where they overlap.

Equipment for this type of bag packaging is generally known. For this, two "folding fingers" which move diagonally inwards toward each other from opposite directions along the first pair of opposing bag projections are used. The fingers fold the first opposing pair of projections into the cross section of the open bag, forming nearly equilateral triangles. At approximately the same time, the second pair of opposing bag projections are folded down into the bag opening at a fold angle of 45° by plates that engage the bag projections from the outside so that the second pair of projections overlap longitudinally across the center of the opening and also cover the corners of the first pair of projections. The second pair of projections are connected to each other in the overlapping area. For the generally known plastic sheet bags this is done customarily by welding of fusing. Any protruding edges can be trimmed at a safe margin to the welded seam. The packaging is thereby cleanly and securely closed.

For reasons of construction, the triangular fold portion of the first pair of bag projections is preferably done with two levers which engage from the left and the right, and the other pair of bag projections are folded from above and below respectively. This folding geometry is suitable for products which are wider than they are tall.

When this orientation is reversed however (i.e., when the bag cross section is taller than it is wide) due to the orientation of the products being packaged, the points of the triangle formed when the first bag projections are folded inwardly would overlap in the middle of the opening, creating problems during the closing of the package and resulting in an unattractive appearance.

For this reason, it is also known to shift the folding tools by 90°. The first projections are then folded from above and below, and the second projections, from both sides. In this way even products which are packed with the taller portion being upright can be packaged without any problems because the first bag projections which form a triangle when folded in are again separated by a large enough margin.

BRIEF SUMMARY OF THE INVENTION

Starting from this point, the purpose of the present invention is to improve both the known packaging bags and the packaging machinery utilized so that one and the same machine can be used to process not only bags having the expected geometry and orientation, but also, at least within certain limits, those where the dimensions are reversed. In particular it should be possible, with a single bag machine, to close bags having a cross section which, when positioned in the machine, has a greater width than height, as well as bags having a cross section with a greater height than width, without generating the described overlapping of the triangles in the center of the bag opening.

The invention accomplishes this in that, when the first bag projections are folded inwards, the sides of the triangular portion formed have a base angle which is less than 45°, and the folded edges between the adjacent bag projections at least partially overlap the outside contour of the bag and the product within the bag laterally when they are folded down.

The invention follows from the understanding that the undesirable overlap of the folded triangular portions after being folded onto the long sides of the product can be avoided when a portion of the bag projection is shifted outwardly in such a manner that it projects laterally over the outer contour of the bag and the product within the bag. For this reason the angle formed between the side of the triangular portion and the base which runs lengthwise along the edge of the product, which was formerly 45° or more, is decreased so that on one hand the triangle which was folded in no longer extends so far into the opening of the bag, and on the other hand the corners of the second bag projections, which are folded in along with the second projections, protrude outwardly.

For paper hygiene products and similar products the packaging bag is generally packaged under a certain excess pressure so that the lateral projection is hardly discernible.

In terms of correct packaging, it is particularly useful if the folded edges of the adjacent bag projections run diagonally toward the outside of the overlapped area when folded down. This also increases the lateral projection in the overlapped area.

The area where the projections overlap when folded down is, as before, purposely located somewhat towards the middle so that the bag projections which were folded down last are joined in this area through either welding or an adhesive, and are trimmed after being connected.

The apparatus for production of the abovereferenced bag packaging is an improvement of the known machinery for bag packaging. To fold the first bag projections inward, this machine uses two folding elements, particularly levers with V-shaped front edges, which move inwardly diagonally from outside in opposite directions along the bag projections. The finger or front edge serves as a fold edge for the triangular portion which is to be folded inwards. Adapting to the fold geometry of the present invention requires that the geometry of the fold edges be changed in such a way that at their imaginary points they form an angle of greater than 90°, and preferably, greater than 100°. Therefore, if the first bag projections extend vertically and are processed by folding elements which engage laterally, it no longer matters whether the bag to be closed has a flattened or an upright profile, or whether the folding of the triangular portions takes place on the narrow side or along the wide side of the bag.

BRIEF DESCRIPTION OF THE SEVERAL VIEWS OF THE DRAWING

The foregoing summary, as well as the following detailed description of preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
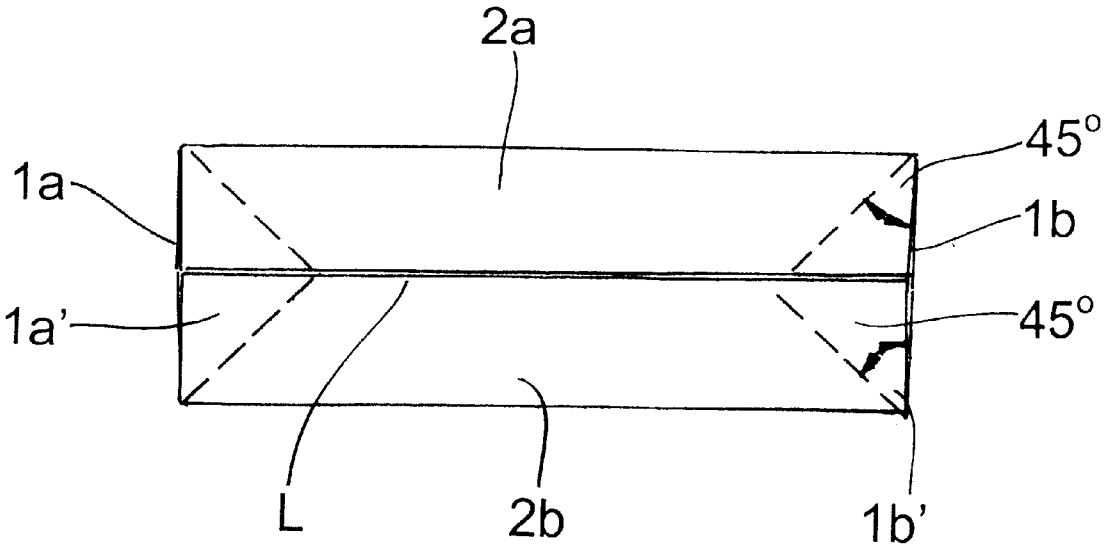
Fig. 1 (PRIOR ART)
FIG. 1 is an elevational view of an end of a prior art bag closure.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the packaging bag and designated parts thereof. The terminology includes the words above specifically mentioned, derivatives thereof and words of similar import.

In the known packaging bags, after a premanufactured bag of plastic, paper, etc. is filled, its open end is folded in and closed. As seen in FIG. 1, both bag projections 1*a* and 1*b* on the narrow side of this type of bag are first folded down so that equilateral triangles 1*a*' and 1*b*' are formed, the bases of which lie along the edges of the product on the narrow side. The fold angle between the base and sides (shown in broken lines) of the triangle is 45°.

As the folding of bag projections 1*a* and 1*b* is being accomplished, bag projections 2*a* and 2*b* on the long side of the bag are simultaneously folded into the opening of the bag, taking the corners of the first bag projections 1*a* and 1*b* down at the same time and covering them. Projections 2*a* and 2*b* meet along the lengthwise center of the bag and are connected together in overlap zone L along the entire length.

Figure 2:
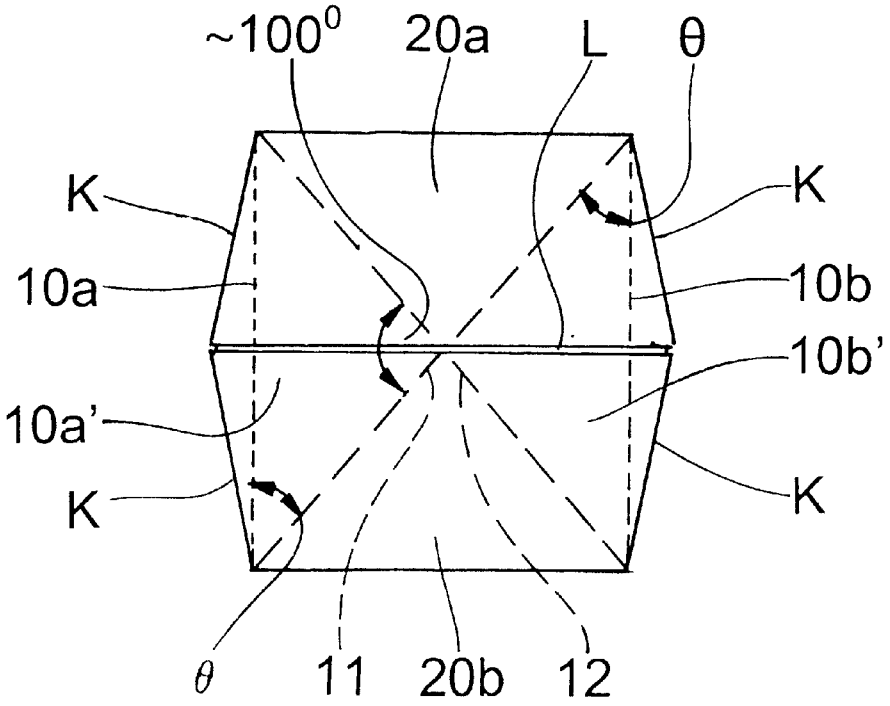
FIG. 2 is an elevational view of a bag closure in accordance with the present invention.

It is readily apparent that this type of fold geometry is only suited for bag cross-sections that lie flat (i.e. have a greater width than height) or are square. For bag cross-sections which have a greater height than width, the generally triangular portions 1*a*' and 1*b*' would overlap with the consequences described. Therefore, according to this invention and as represented in FIG. 2, the first bag projections 10*a* and 10*b* are folded in with a base angle Θ of less than 45°, preferably less then 40°. The generally triangular portions 10*a*' and 10*b*' formed by folding the first bag projections 10*a* and 10*b* therefore have an angle of greater than 90°, and preferably greater than 100°, and do not extend so far into the bag opening such that the undesired overlapping of the triangle tips 11, 12 can be avoided. In fact, it is within the scope of the invention for each individual triangle tip to overlap, as opposed to the fold geometry in FIG. 1. This, however, neither hinders the further closing of the bag nor is visually apparent.

The majority of the material of the bag projections 10*a* and 10*b* is pushed out laterally when the other bag projections 20*a* and 20*b* are folded in, so that the folded edges K between the adjacent bag projections 10*a*, 20*a*, 10*b*, 20*b* no longer run along the outside contour of the bag or the product within the bag as in FIG. 1, but run diagonally to the outside until they reach their maximum overlap in the center area of the package, in an overlap zone L.

Bag projections 20*a* and 20*b* meet each other at the center lengthwise area and are connected together thereby welding, fusing, an adhesive connection, or by any other suitable method. In contrast to FIG. 1, however, this overlap zone L extends beyond the outside contour of the bag on both sides.

Figure 4:
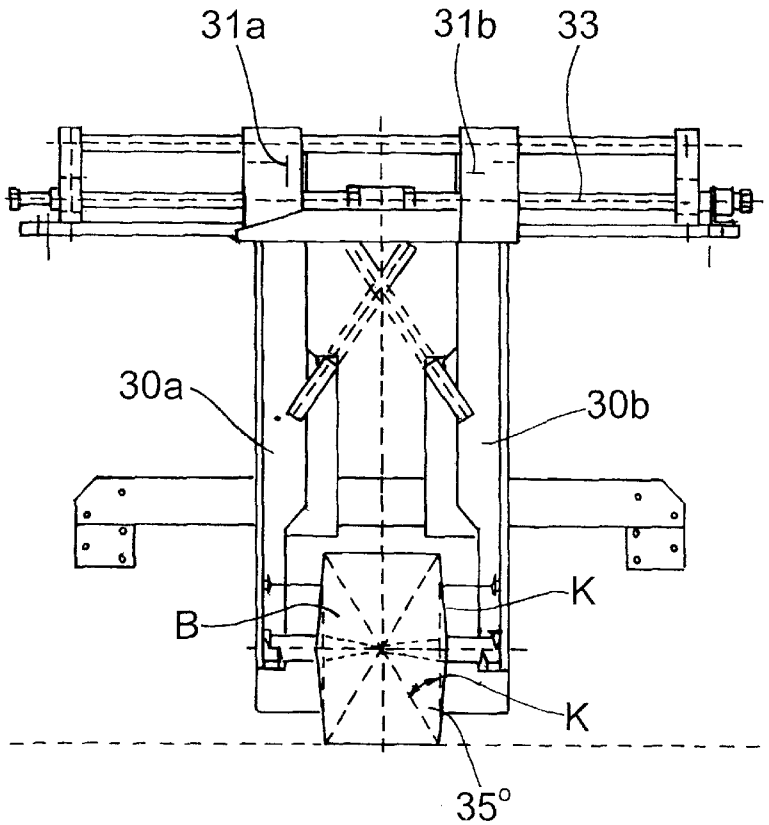
FIG. 4 is a front view similar to FIG. 3 showing the bag folded.
Figure 3:
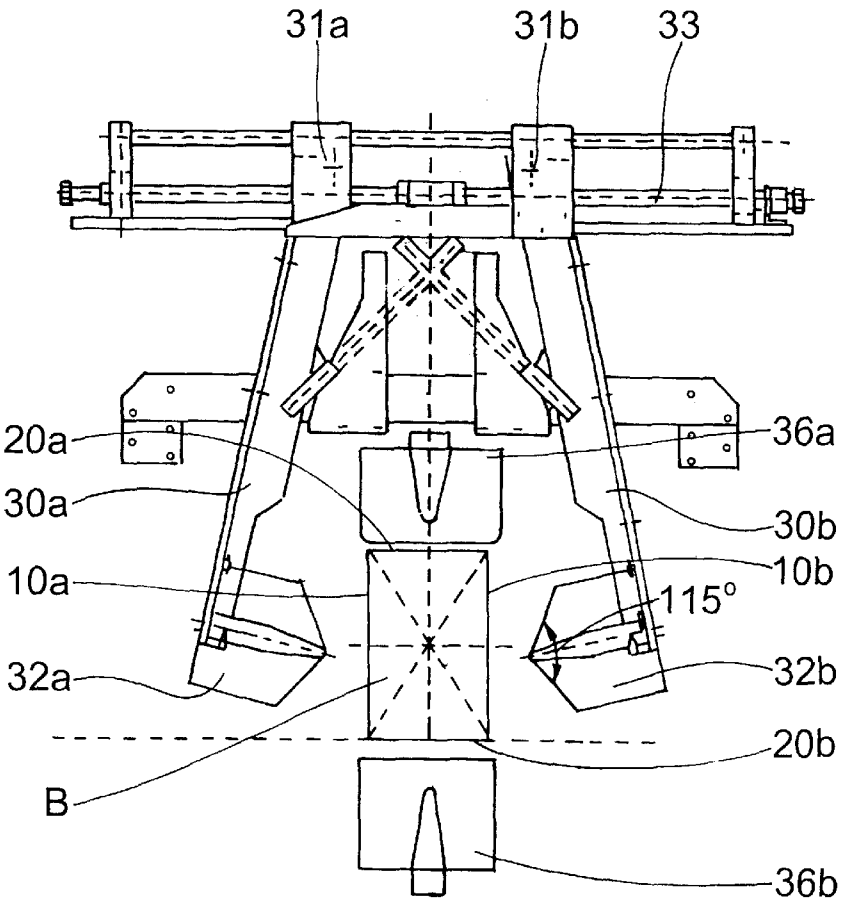
FIG. 3 is a front view of the closing equipment before the product advances for folding the bag end projections to form the closure.

FIGS. 3 and 4 show equipment for production of bag packaging according to the invention. The equipment is schematically represented, with reference being made to the improvements provided by the president invention.

Two folding elements 30*a* and 30*b* are provided in the form of pivoting levers supported on the upper ends by drag bearings 31*a* and 31*b* and having V-shaped folding edges 32*a* and 32*b* on their lower ends. The pivoting levers are actuated in a known manner, by either hydraulic or pneumatic cylinders, and are moved inwardly on both sides from the open position, illustrated in FIG. 3, against the first pair of bag projections 10*a*, 10*b* of the filled package B, so that folding edges 32*a* and 32*b* meet approximately in the middle of the first, vertically lengthwise extending bag projections 10*a* and 10*b*. Nearly simultaneously, folding plates 36*a*, 36*b* are applied to bag projections 20*a* and 20*b* along the narrow sides of the bag from above and below. In the course of this combination folding movement, bag projections 10*a* and 10*b* along the long dimension of the bag are folded in to form the triangular portions, and bag projections 20*a* and 20*b* on the narrow edge of the bag are folded over them.

The folding elements are withdrawn and bag projections 20*a* and 20*b* are connected together in overlap area L, as described above. Through the use of an obtuse angle on the points of the folding edges, shown as approximately 115° in the presently preferred embodiment, bag projections 10*a* and 10*b* along the lengthwise sides of the bag each form a triangular portion having a base angle Θ of less than 40°.

FIG. 4 illustrates folding edges 32*a* and 32*b* after they have been brought together. The fold geometry is selected so that both triangular portions 10*a*', 10*b*' folded in along the long sides of the bag meet nearly in the middle of the bag opening. As a result, the lateral projections produced along these lengthwise sides increases because fold edge K between the lengthwise and transverse bag projection no longer follows the contours of the product, but rather project out laterally. If bags which lie flat are packaged with the same machine instead of the upright bag shown, the pivoting levers 31*a* and 31*b* are adjusted to be somewhat closer together by adjusting the spindle 33, which increases the distance between the lower ends of the pivoting levers and between fold edges 32*a* and 32*b*. It is preferable, but not necessary, to exchange the folding edges 32*a*, 32*b* with edges having a right-angle corners. No additional adjustment is required for the machine.

In this way, with the same machine, the triangular portions of the bag projections which are folded in can be created not only on the narrow sides which are relatively far apart, but also on the longer sides of a bag which are spaced together.

What is claimed is:

1. Apparatus for closing a packaging bag, the packaging bag including a bag having a bag end with four projecting bag sides defining first and second pairs of opposing bag projections of the type that are folded over a product in such a way that the first pair of opposing bag projections are folded onto the product forming generally angular portions, each triangular portion including a base which is positioned along one edge of the product and two sides which extend diagonally inwardly from the base, the second pair of opposing bag projections being folded onto the triangular portions formed by the first pair of opposing bag projections with fold corners being located between adjacent bag projections, the second pair of opposing bag projections maintaining an approximately rectangular form, the second pair of opposing bag projections covering the fold corners of the first bag projections, the sides of each of the triangular portions forms an angle with the base which is less than 45°, and the fold edge between the adjacent bag projections extends at least partially laterally beyond the product contour to form a flat closed bag end located in one plane, the apparatus comprising two folding elements mounted for inward movement from opposite sides for engaging the first opposing pair of bag projections, each said folding element having a V-shaped front edge which cooperates with folding plates mounted for inward movement from opposite sides at right angles to the inward movement of the folding elements to function as a folding edge to form each of the triangular portions, the V-shaped front edge of each said folding element having an angle greater than 90°, the folding elements and the folding plates each having a planar surface, the planar surfaces of the folding elements and the folding plates being movable to a position parallel to the plane in which the flat closed bag end is to be formed to form the flat closed bag end.

2. The apparatus according to claim 1 wherein the front edge of each said folding element has an angle greater than 100°.

3. The apparatus according to claim 1 further characterized in that the folding elements are adapted to engage and fold bag projections for bags having a cross-section which has a greater width than height and for bags having a cross-section with a greater height than width.

4. Apparatus for closing a packaging bag, the packaging bag including a bag having a bag end with four projecting bag sides defining first and second pairs of opposing bag projections of the type that are folded over a product in such a way that the first pair of opposing bag projections are folded onto the product forming generally triangular portions, each triangular portion including a base which is positioned along one edge of the product and two sides which extend diagonally inwardly from the base, the second pair of opposing bag projections being folded onto the triangular portions formed by the first pair of opposing bag projections with fold corners being located between adjacent bag projections, the second pair of opposing bag projections maintaining an approximately rectangular form, the second pair of opposing bag projections covering the fold corners of the first bag projections, the sides of each of the triangular portions forms an angle with the base which is less than 45°, and the fold edge between the adjacent bag projections extends at least partially laterally beyond the product contour, the apparatus comprising first folding means mounted for inward movement from opposite sides for engaging the first opposing pair of bag projections for folding each of the first opposing pair of bag projections inwardly to form the bases of the triangular portions located along the edges of the product, the first folding means including two folding elements, each having a V-shaped front edge which functions as a folding edge to form each of the triangular portions, the front edge of each of the folding elements having an angle greater than 90°, and second folding means for folding each of the second opposing pair of bag projections over the first opposing pair of bag projections to form a flat closed bag end with the fold edge between the adjacent bag projections extending at least partially laterally beyond the product contour.

5. Apparatus for closing a packaging bag in combination with a packaging bag including a bag having a bag end with four projecting bag sides defining first and second pairs of opposing bag projections of the type that are folded over a product such that the first pair of opposing bag projections are folded onto the product forming generally triangular portions, each triangular portion including a base which is positioned along one edge of the product and two sides which extend diagonally inwardly from the base, the second pair of opposing bag projections being folded onto the triangular portions formed by the first pair of opposing bag projections with fold corners being located between adjacent bag projections, the second pair of opposing bag projections being approximately rectangular in form, the second pair of opposing bag projections covering the fold corners of the first bag projections to form a closed flat end on the packaging bag, the sides of each of the triangular portions forms an angle with the base which is less than 45°, and the fold edge between the adjacent bag projections extends at least partially laterally beyond a product contour defined by the bases of the first pair of opposing bag projections, the apparatus comprising folding element means for engaging each of the first opposing pair of bag projections and folding each of the first opposing pair of bag projections inwardly to form the bases of the triangular portions located along the edges of the product and the sides of the triangular portions which have the base angle of less than 45°, and lateral folding plate means for folding the second pair of opposing bag projections over the first pair of opposing bag projections to form the closed flat end of the packaging bag with the fold edges of the second pair of opposing bag projections extending over the bases of the folded first pair of opposing bag projections.

6. The combination of claim 5 wherein the folding element means include V-shaped folding elements having an angle greater than 90°.

7. The combination of claim 6 wherein the folding elements are mounted on pivoting levers which are adjustably mounted for positioning closer together or further apart depending on a size of the bag to be folded.

8. The combination of claim 6 wherein the V-shaped folding elements each include a planar surface, the planar surfaces being located in and movable in a plane parallel to a plane defined by the bases of the triangular portions.

* * * * *